US005459887A

United States Patent [19]

Roman et al.

[11] Patent Number: 5,459,887

[45] Date of Patent: Oct. 24, 1995

[54] PORTABLE SITZ BATH AND THERAPEUTIC CHAIR

[75] Inventors: D. Garry Roman, Westlake Village; Bruno A. Rist, Woodland Hills, both of Calif.

[73] Assignee: Garry D. Roman, Westlake Village, Calif.

[21] Appl. No.: 295,494

[22] Filed: Aug. 25, 1994

Related U.S. Application Data

[63] Continuation of Ser. No. 23,799, Feb. 22, 1993, abandoned.

[51] Int. Cl.[6] ..... A47K 3/022; A61H 33/02

[52] U.S. Cl. ..... 4/541.4; 4/541.2; 4/574.1; 4/590

[58] Field of Search ..... 4/541.4, 541.1, 4/541.2, 541.3, 574.1, 589, 590

[56] References Cited

U.S. PATENT DOCUMENTS

| | | | |
|---|---|---|---|
| 1,856,318 | 5/1932 | Clarke | 4/541.3 |
| 2,589,280 | 3/1952 | Ocana | 4/590 |
| 3,571,818 | 3/1971 | Jacuzzi | 4/541.4 |
| 3,797,482 | 3/1974 | Nicollet | 4/541.4 |
| 3,900,902 | 8/1975 | Jarosinski | 4/590 X |
| 4,466,141 | 8/1984 | Starkey | 4/541.3 X |
| 4,953,240 | 9/1990 | Gardenier | 4/541.4 X |
| 5,044,357 | 9/1991 | Johns | 4/541.4 X |
| 5,079,784 | 1/1992 | Rist et al. | 4/541.4 X |

*Primary Examiner*—Robert M. Fetsuga
*Attorney, Agent, or Firm*—David O'Reilly

[57] ABSTRACT

A portable sitz bath therapeutic chair having a substantially rectangular frame to provide a backrest, armrest and a leg rest that enclose and form a basin for holding heated water. Wheels mounted at the corners of the frame allow the chair to be moved about. The chair also includes controls for circulating the heated water to maintain the temperature and provide a massaging action. Controls on the armrest of the chair allow the a heating and pumping system to be turned on and off by a patient. The electronic circuit for circulating the heated water in the chair includes safety devices to prevent operation should the pump for circulating the water not be working or if a malfunction causes the water to overheat.

14 Claims, 4 Drawing Sheets

PORTABLE SITZ BATH AND THERAPEUTIC CHAIR

This is a continuation of application Ser. No. 08/023,799 filed on Feb. 22, 1993, abandoned.

FIELD OF THE INVENTION

This invention relates to a bath system know as a sitz bath and more particularly relates to a portable sitz bath therapeutic chair.

BACKGROUND OF THE INVENTION

A sitz bath is a bath for bathing in a sitting position and also treating the affected areas of a patient. In this type of device the patient literally sits in the bath which is filled with heated water that may or may not include medication for treating the affected area.

There are presently available small portable tubs and fixed closet installations that are used for the purpose of a sitz bath but they are inadequate, inconvenient and messy. It is difficult or impossible to contain the water in the tub, difficult to maintain the desired temperature and very patient unfriendly and uncomfortable. It would be advantageous if a sitz bath could be provided at the bedside where the person can be bathed and treated, particularly when the patient is marginally ambulatory.

A number of devices are available for treating invalid patients in baths but in those cases those patients must first be transported to the bath. For example, in U.S. Pat. No. 2,648,849 a chair is described for use with invalid patients. In this patent a seat is removably positioned over a bathtub. The patient may then be positioned in the chair and then lowered into the tub.

A similar device is disclosed in U.S. Pat. No. 3,280,409 in which a lift is provided for a sitz bath. In this patent a hydraulically operated lift is provided over a tub. The lift will raise and lower a chair that is mounted on a swivel. A non-ambulatory patient can be seated on the chair positioned over the tub and then lowered into the water in the tub.

There is also a bath system for people constrained to wheelchairs described in U.S. Pat. No. 3,662,409 issued May 16, 1972. In this patent a bath having a shape similar to a chair is designed for use in domestic bathrooms. The bath has a door on a forward portion that opens allowing a person in a wheelchair to enter the bath. The door is then closed. Controls are provided for filling the tub with water and discharging the water after the bath. The bath system is not portable and therefore cannot be transported to the place where the patient is to be treated.

There is also a primitive portable personal sitz bath kit that includes a tub and a hot water bottle. The hot water bottle is filled with temperate water and hung up at some convenient place. The patient then sits in the tub placed on a suitable surface and the water is released from the water bottle. The tub is preferably constructed to fit the shape of a toilet bowl, so that the toilet bowl can be used as a seat. After use, the tub is emptied into the toilet bowl, rinsed and stored. While this is economical, it is not very convenient or comfortable and certainly would not be useful for non-ambulatory patients.

In present practice in hospitals, patients who need to be treated in a sitz bath are transported by wheelchair or a gurney to the site of the sitz bath, usually a small closet-like enclosure. The patient is then placed in the sitz bath for a period of time sufficient for treatment. Water in the bath is kept fairly temperate but sufficient to provide the proper treatment. Temperatures generally do not go much over 100° with a maximum of 105° being preferred. After treatment the patient must be dried and transported back to his room and placed in his bed. This is inconvenient and hazardous for marginally ambulatory patients and can lead to considerable trauma. It would be advantageous if a sitz bath could be transported to the side of the patient's bed for treatment°

It is therefore one object of the present invention to provide a portable sitz bath and therapeutic chair that is easily transported to the patient's bedside for treatment.

Yet another object of the present invention is to provide a portable sitz bath and therapeutic chair which is comfortable and completely self contained for providing sitz bath treatment of a patient.

Still another object of the present invention is to provide a portable sitz bath therapeutic chair that has an electronic circuit to maintain the temperature of the water during treatment of the patient and provide therapeutic water streams and agitating bubbling action of said streams.

Yet another object of the present invention is to provide a portable sitz bath therapeutic chair with readily available convenient controls for the patient or a hospital worker to use during treatment.

BRIEF DESCRIPTION OF THE INVENTION

The purpose of the present invention is to provide a portable sitz bath and more particularly a portable sitz bath therapeutic chair that can be transported to the patient's bedside for treatment.

The portable sitz bath therapeutic chair has the shape of a conventional chair with a back, a seat portion and arms that form a basin. The chair is formed with a frame that is mounted on casters or wheels for transport from place to place. The wheels preferably include locks for holding the chair in position when in use.

The seat of the portable sitz bath therapeutic chair is constructed to form a basin for holding sufficient water to treat the low back, perineal and hip areas of a patient. A basin depth of up to nine inches to twelve inches is preferable. A shelf is included in the basin for raising the posterior portion of a patient a few inches above the bottom to allow the water to circulate around the area being treated.

The basin includes nozzle jets for circulating the water to stimulate treatment and aeration jets for aerating the water. Aeration of the water is beneficial for treating patients in spas and other areas and can be beneficial for use with a sitz bath to provide a massaging and cleansing action.

The basin of the portable sitz bath therapeutic chair is filled either by pouring heated water into the basin from the top or by a hose fitting to connect the sitz bath therapeutic chair to a spigot. Electronic controls are provided along one side of the arm of the chair to allow the patient to control the circulation of the heated water to maintain the temperature as well as permitting aeration of the water if desired. These controls are similar to those controls used in whirlpool tubs and spas.

The sitz bath chair is used by lowering the patient, either manually or by a crank or hydraulically operated lift system, into the chair as in a normal seat with the patient's back resting against the backrest of the chair. The chair has arms and can include a foot rest to extend the legs and provide some additional support and comfort as desired. Temperate water is first added to the basin to a level a few inches below the top. Only a few inches of water is needed to provide treatment of the affected areas.

Treatments usually are on the order of ten to twenty minutes. If the water begins to cool the patient may operate a switch to circulate the water through a heater to maintain the temperature and also aerate the water if desired. The water is circulated through a conduit system which includes a pump and a heater. The pump also provides aeration to the water to provide a massaging action for more effective treatment.

The above and other features of this invention will be fully understood from the following detailed description and the accompanying drawings, in which:

DETAILED DESCRIPTION OF THE INVENTION

Figure 1:
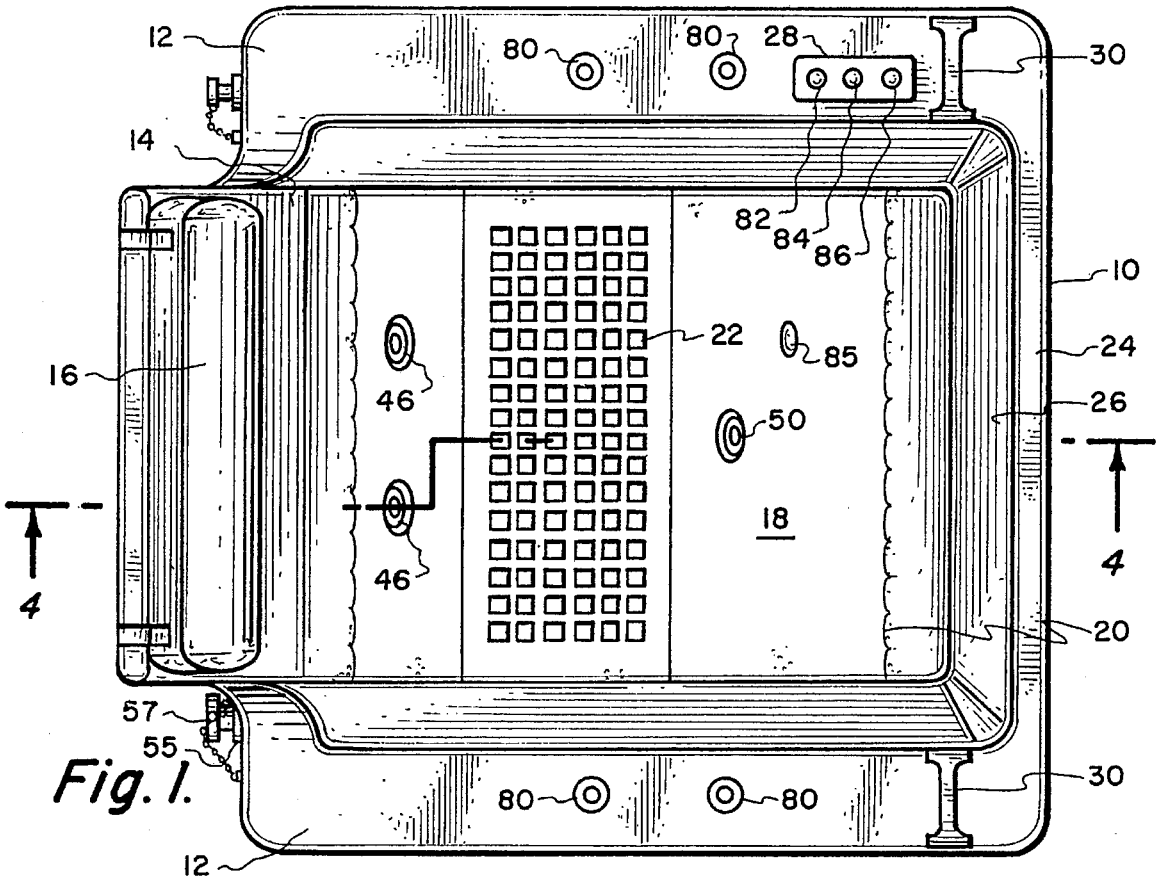
FIG. 1 is a top elevation of a portable sitz bath therapeutic chair constructed according to the invention.
Figure 3:
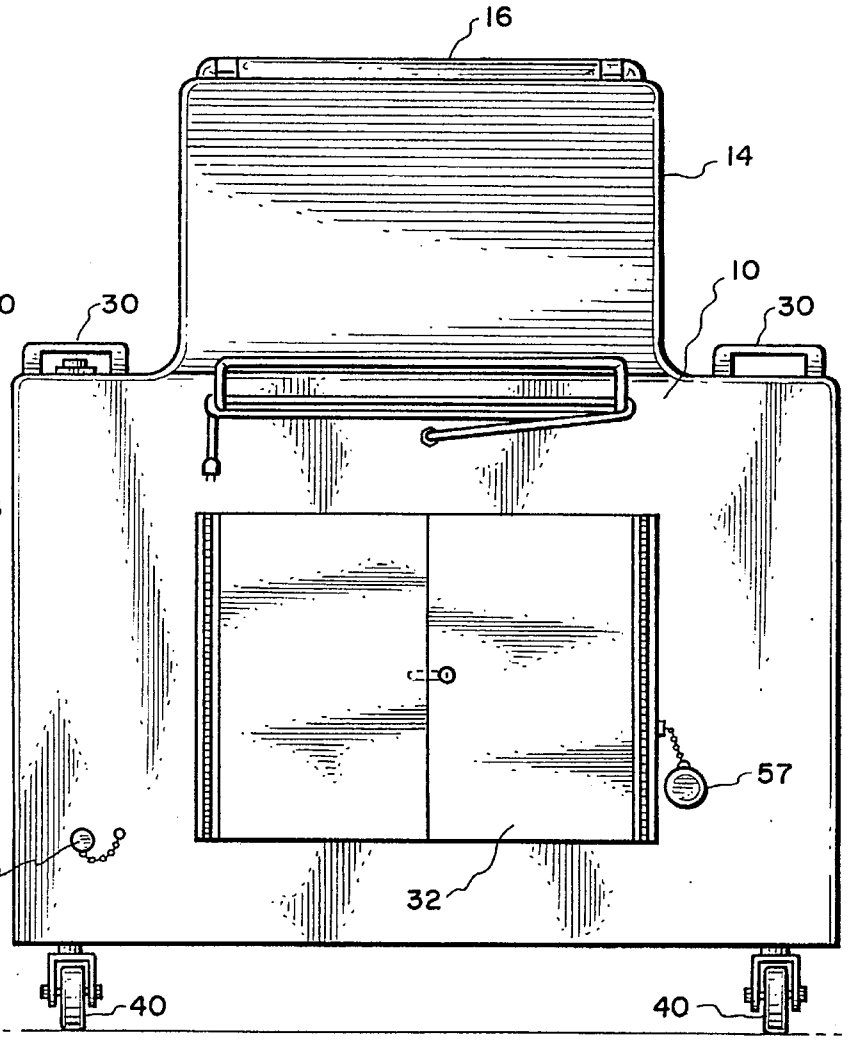
FIG. 3 is a rear view of the portable sitz bath therapeutic chair constructed according to the invention.
Figure 2:
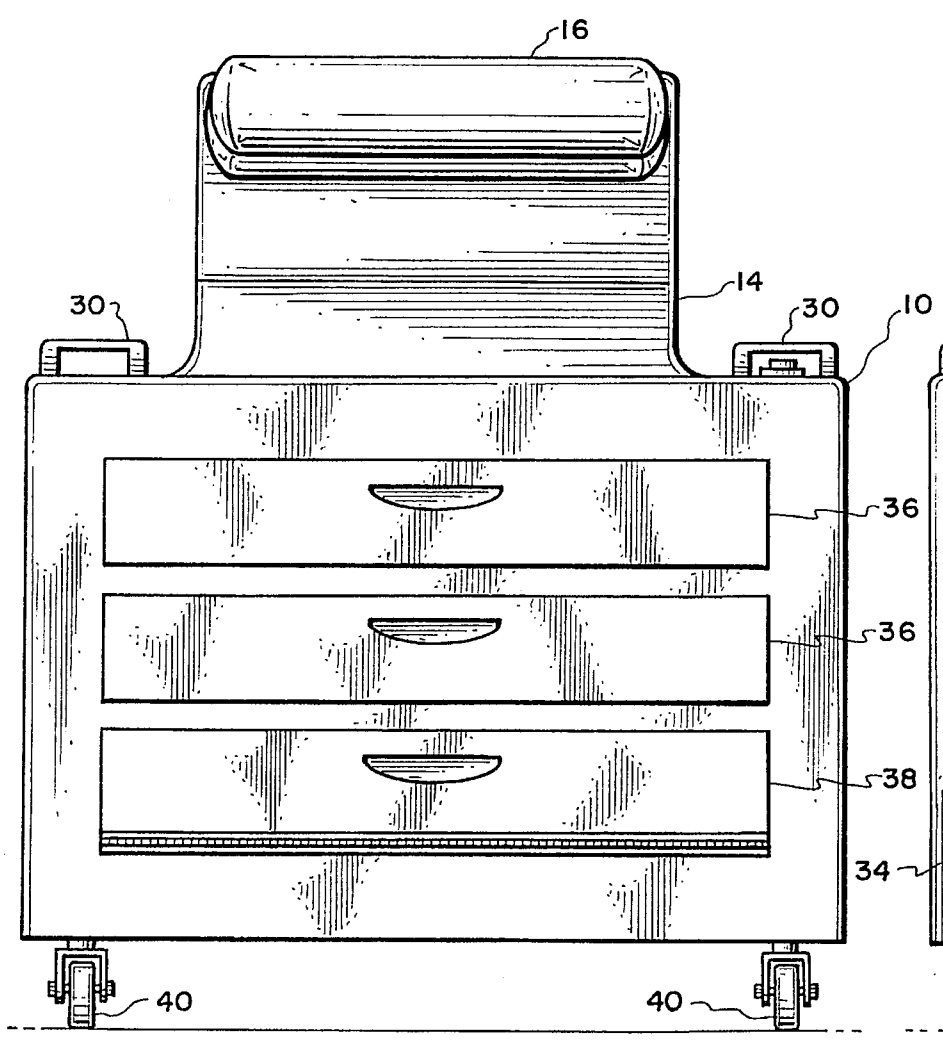
FIG. 2 is a front elevation of a portable sitz bath therapeutic chair constructed according to the invention.

The portable sitz bath therapeutic chair is shown generally in FIGS. 1–3. The chair is comprised of a somewhat square frame 10 having arms 12, and basin portion 18 for holding water 20. The backrest 14 and head rest 16 are optional features. A perforated shelf 22 in basin 18 allows water 20 to completely circulate around a patient sitting in the chair for best treatment.

A leg support 24 across the front of the chair has a sloped side 26 for comfortably supporting the legs of a patient. Operating controls 28 are provided for controlling operation of the chair, which will be described in greater detail hereinafter. Handles 30 are provided on the front portion of each armrest 12 to allow the chair to be easily moved and facilitate entry and exit from the bath.

Rectangular frame 10 provides an enclosed area beneath basin 18 for storing components and operating the chair. Access to the components is provided through hinged access doors 32 that can be seen more clearly in FIG. 3. Additionally a drain plug 34 is provided for removing water from the basin, as will also be described hereinafter.

Rectangular frame 10 also allows storage in small areas at the front. These can be storage drawers 36 or a storage for compartment 37 accessed through drop down door 38. To move the chair about wheels 40 are provided on each corner of the frame. Preferably these are standard locking type casters so the chair can be locked in position when the chair is in use. The locks can be released to move the chair from one position to another.

A unique aspect of the invention is the inclusion of a system for enhancing treatment of a patient sitting in the chair. While the chair could be simply used as a basin allowing the patient to sit in heated water previously added to the chair, treatment is enhanced by a system for circulating the water and maintain the temperature and also provide the therapeutic effect of a warm circulating flow through nozzle jets. This enhances the treatment effect by providing a massaging effect in addition to the heat. This system is shown generally in FIGS. 4 and 5 in which patient 15 shown in phantom, is sitting in the chair during treatment. Water 20 in basin 18 is circulated by motor 42 and pump 44 through pipes to adjustable nozzle jets 46, 48 and 50 in basin 18.

Figure 5:
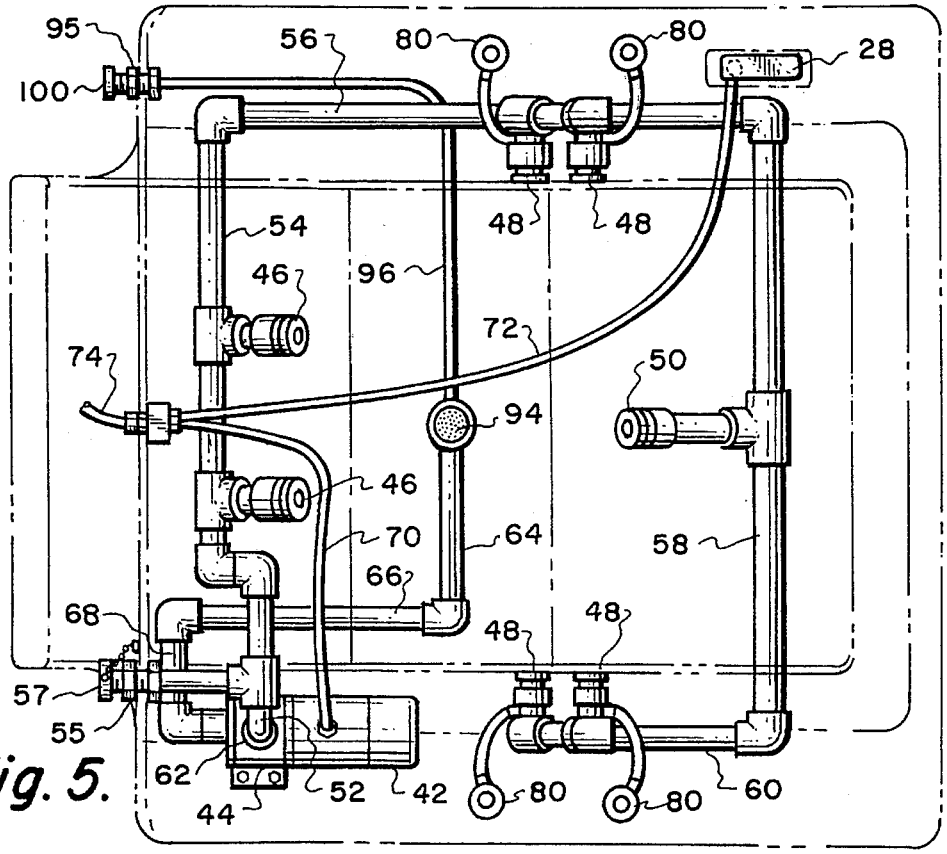
FIG. 5 is a schematic diagram of the plumbing arrangement of the portable sitz bath therapeutic chair.

The arrangement of nozzle jets 46, 48 and 50 circulating system can be more clearly seen in the plumbing schematic diagram of FIG. 5. Nozzle jets 46, 48 and 50 are connected by return pipes 52, 54, 56, 58 and 60 connected to outlet 62 on pump 44. Water is drawn into pump 44 through drain 94 and conduits 64, 66, and 68. Thus pump 44 draws water from the basin 18 and recirculates it to nozzles jets 46, 48 and 50 to provide a massaging action in addition to the therapeutic effect of the heated water. Additional medication may be added to the water if desired.

Electrical control 28 and drive motor 42 are connected by power cords 70 and 72 to power cord 74 that can plug into a standard 110 AC outlet. If desired a safety power switch (not shown) can be provided on the back of the frame 10 of the chair so that the patient may not operate the controls 28 until a hospital worker has plugged in power cord 74 and turned on the power.

Added stimulus and massaging action can be provided by the addition of air through adjustable air intakes 80 mounted on the arm of the portable sitz bath therapeutic chair. Adjustments of these nozzles aerates the water flowing to nozzle jets 46 and 48. Air intakes 80 can be adjusted from maximum air to no air added.

The system is controlled by an electronic circuit on circuit board 76 connected to operating controls 28 having three momentary pushbutton control switches. Switch 82 turns the power on and off while switches 84 and 86 control the pump for circulating water and the heater respectively. Thus a patient sitting in the portable sitz bath therapeutic chair can control the system completely for maximum comfort, stimulation and massage. Power cord 74 is mounted on power cord holder 78 on the back of chair frame 10.

Figure 6:
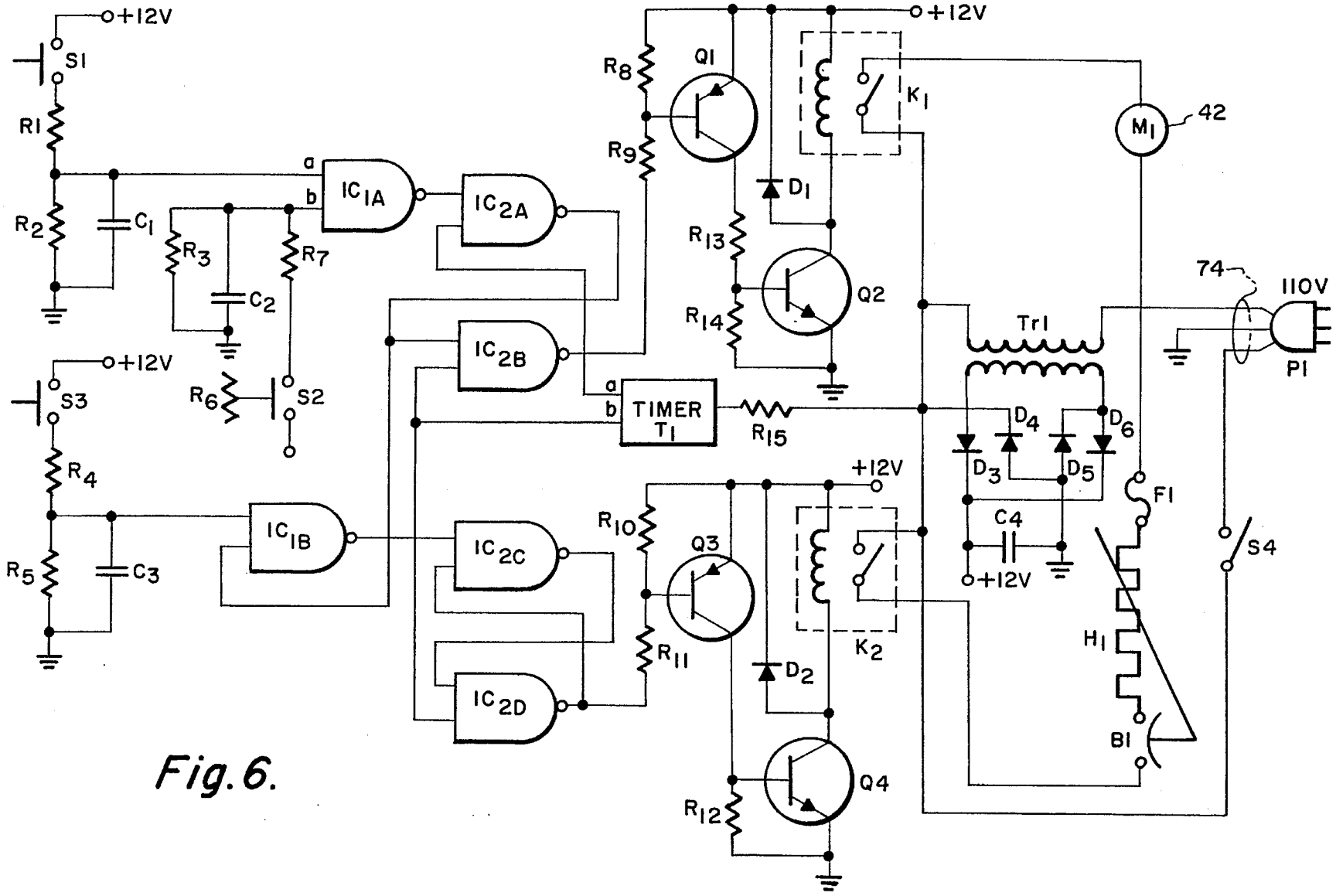
FIG. 6 is a schematic diagram of a system for operating the portable sitz bath therapeutic chair.

An electronic circuit for controlling the operation of the portable sitz bath therapeutic chair is illustrated in FIG. 6. The circuit of FIG. 6 shows pump switch $S_1$, power on switch $S_4$ (82) which is mounted on control panel 28 on the arm of the chair. Pump switch $S_1$ (84) which is preferably a momentary pushbutton switch turns pump 44 on and off. Attached to pump switch $S_1$ is an optional noise suppression circuit comprised of resistor $R_1$ and capacitor $C_1$. If pump switch $S_1$ were remote from the circuit it is wired to, it might be advisable to have noise suppression RC circuit. Noise suppression circuit of resistor $R_1$ and capacitor $C_1$ provide noise immunity.

Figure 4:
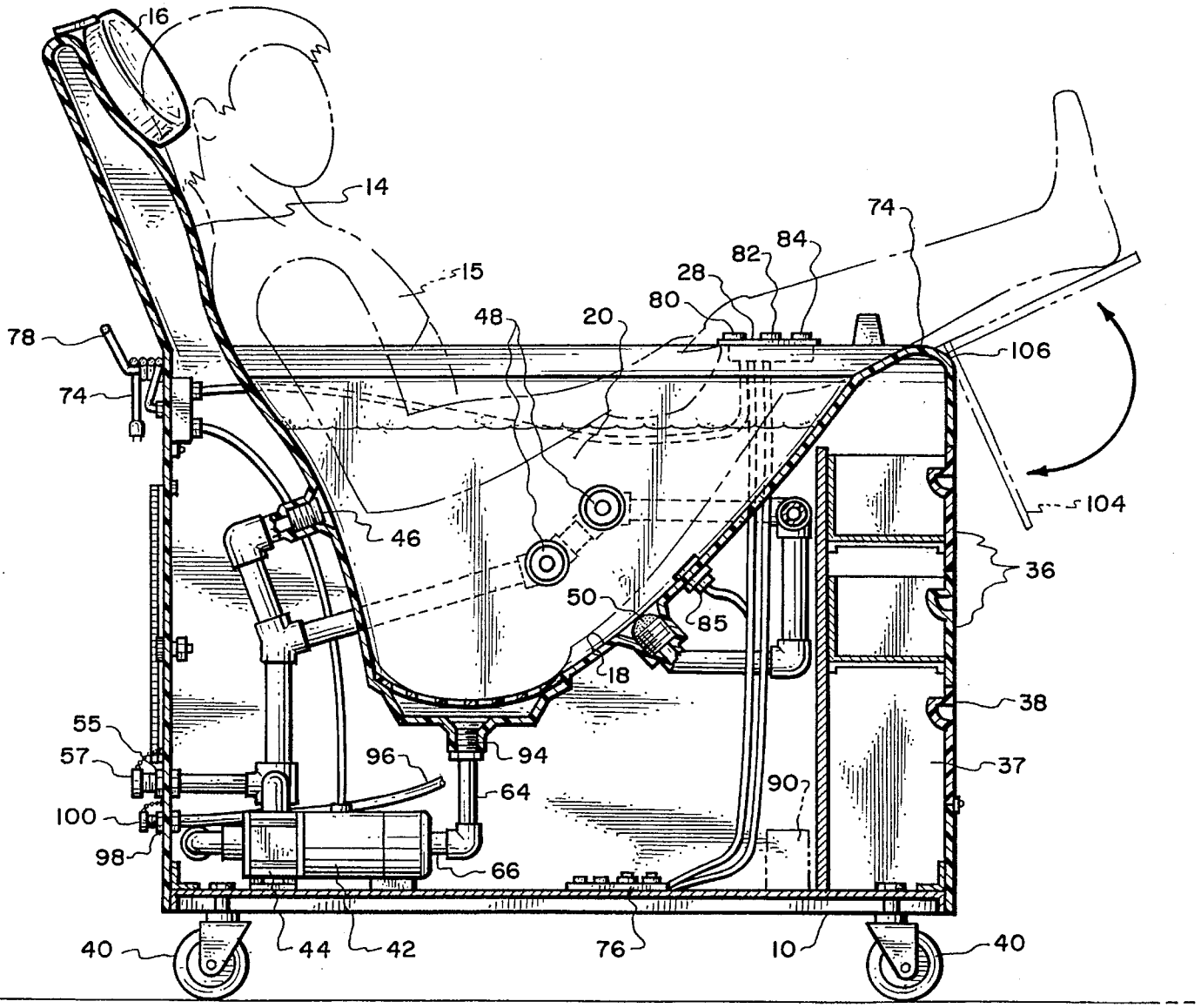
FIG. 4 is a sectional view of the portable sitz bath therapeutic chair taken at 4—4 of FIG. 1.

Momentary operation of pushbutton pump switch $S_1$ attempts to activate integrated circuit $IC_{1a}$. In other words, operation of the switch will pull $IC_1$ input "a" to a high state. A second input "b" will already be high if basin 18 is full of water activating float switch $S_2$ (85). This can be any suitable float switch 85 mounted at a level in basin 18 as shown in FIG. 4 to be certain there is sufficient water to treat the patient. Preferably basin 18 will allow a water height of nine to twelve inches so a float switch positioned at approximately six to eight inches will be adequate. If there is no water in the chair, then float switch $S_2$ will be open preventing input "b" on $IC_{1a}$ from being high.

If both inputs "a" and "b" to $IC_1$ are high then the output will go low which will set a latch provided by an integrated circuit comprised of $IC_{2a}$ and $IC_{2b}$. With this latch set low, the output of IC 2b is low and PNP transistor $Q_1$ turns on which will then turn on NPN transistor $Q_2$. This energizes relay $K_1$ turning on pump motor $M_1$ (42). With pump motor $M_1$ running and the output of IC 2b low, a reset is removed from a timer $T_1$ terminal "a" which starts a timing sequence. Once the time set by timer $T_1$ has elapsed, a reset signal to latch $IC_{2b}$ causes pump motor $M_1$ to shut off. The period of time determined by timer $T_1$ is approximately ten minutes. The count down time signal for timer comes from resistor $R_{15}$. Preferably the time set by timer $T_1$ is not adjustable and can be set for another ten minutes simply by pushing pushbutton pump switch $S_1$ again.

When pump motor $M_1$ is on, integrated circuit $IC_{2a}$ is high which enables gate $IC_{1b}$. When integrated circuit $IC_{1b}$ is enabled heater switch $S_3$ is pushed on gate $IC_{1b}$ goes low which sets integrated circuit $IC_{2c}$ and $IC_{2d}$ latch such that it turns on transistor $Q_3$. This turns transistor $Q_4$ on which turns relay $K_2$ on, applying power to heater $H_1$ through bimetal temperature control $B_1$. If pump motor $M_1$ (42) is not on gate $IC_{2C}$ is disabled and will prevent any attempt to turn heater $H_1$ on by pressing push button switch $S_3$ because the command cannot pass through. Heater $H_1$ can be mounted inside intake line 66 or some other suitable location such as in outlet conduit 52. The water that is circulated from the basin through intake nozzle 94 back to nozzle jets 46, 48 and 50 is thus heated as it is circulated by pump 44. At the end of the timing cycle heater $H_1$ shuts off with motor $M_1$ since both latches are reset by a signal from terminal b of timer $T_1$. AC power is applied through plug $P_1$ connected to power cord 74.

While the system may be operated with DC power it is not practical with the use of heater $H_1$ because of the amount of power required. However it is possible to operate without a heater by providing AC power through battery 90 illustrated in phantom in FIG. 4 which can be mounted in frame 10 of the sitz bath therapeutic chair. To operate on battery power preheated water would be added to basin 18 and would simply be circulated by motor $M_1$ and not heated.

In order to include heater $H_1$ which requires the use of AC power because DC power is not practical, the system is designed so that relays $K_1$ and $K_2$ and the high voltage parts are isolated preventing any danger to a patient under treatment. Anything a patient being treated would have access to would then run off low voltage. Control transformer $TR_1$ provides the high isolation required for safety purposes. DC power for use with the heater would be impractical because the heater would have to be approximately 500 watts or so.

The circuit for Heater $H_1$ includes a thermostatic temperature control in the form of a bimetal temperature control device $B_1$. This prevents the water from overheating 11, by opening when the temperature of the water gets above a predetermined temperature. As the water cools down the bimetal temperature control would close again allowing heater $H_1$ to turn on. Preferably the temperature would be set to a limit of about 105° to avoid harm to a patient. Normal temperatures in the range of 102° to 105° F. would be most desirable. Additional protection would be provided by a thermal fuse $F_1$. Should bimetal temperature control device $B_1$ not work, thermal fuse $F_1$ would open if the temperature exceeded a predetermined amount. Thermal fuse $F_1$ could be selected to open up at some reasonable temperature say 110° F. or below a temperature which might cause harm to a patient.

Another safety feature is provided by heater on switch $S_3$. Heater on switch $S_3$ will not turn heater $H_1$ on if pump $M_1$ (42) is not operating. This is because the pump motor latching system of integrated circuits $IC_{2a}$ and $IC_{2b}$ prevent the output of $IC_{2c}$ and $IC_{2d}$ from operating.

The uniqueness of the circuit disclosed is in its simplicity and compactness. The parts to manufacture and use the circuits would be inexpensive and small enough to fit in the open area beneath the frame of the portable sitz bath therapeutic chair. Transformer $TR_1$ would preferably be a 120 volt to 10 volt AC transformer. If desired a lamp or LED (light emitting diode) for power indication and a resistor (not shown) can be added to the circuit. The light would show when power is on whenever pump switch $S_1$ is activated. Float switch $S_2$ (85) controlled by resistor $R_6$ is similar to the type of float switch that is used in dishwashers. The switch can be a rubber diaphragm type switch, well known in the art, in which the weight of the water pushes on the diaphragm to operate the switch. If there is no water in the reservoir or the chair, switch 85 is off and pump 44 cannot come on. This would 11. prevent the basin from running dry which could cause damage to pump motor $M_1$ and ruin the bearings.

Thermal fuse $F_1$ provides fail safe protection should pump motor $M_1$ freeze. The pump motor latch integrated circuit $IC_{2b}$ would be enabled but water would not flow and would overheat. Thermal fuse $F_1$ would then open at the designed temperature maximum (e.g. 110° F.) because it is a physical device. The designed temperature is determined by a piece of metal in fuse $F_1$ having a melting point which cannot change. Thus it would provide fail safe protection. The bimetal temperature control $B_1$ is backed up by thermal fuse $F_1$ providing double protection. Preferably the maximum temperature of the system would run in the range of 102°–105°.

After use water is removed from the portable sitz bath therapeutic chair through a drain 94 beneath support shelf 22 in basin 18. Water is drained through drain pipe 96 to outlet 98 kept closed by drain plug 34. The water can simply be allowed to drain into a container for dumping or a hose could be connected to outlet 98 for removing water.

Optionally a drain outlet 55 having plug 57 could be connected to pipe 52 coming from pump 44. Removing plug 57 from drain outlet 55 allows removal of the water from the basin 18 by simply operating pump 44 with the drain open to either a container or through a hose to a dispersal area.

In use the portable sitz bath therapeutic chair would be brought to the bedside of a patient. It would be most suitable for patients who are bedridden and not ambulatory. Patient 15 could then be lifted into the chair, seated comfortably on shelf 22 with his legs extended over leg rest 24 on the forward portion of frame 10 of the portable sitz bath therapeutic chair. Optionally an adjustable shelf 104 illustrated in phantom can be connected by a hinge 106 to the forward portion 24 of the portable sitz bath therapeutic chair to provide support for the lower portion of a patient's legs. The patient can be seated in the chair and heated water 20 added or could already be in basin 18. Preferably water at the appropriate temperature would be added to the basin before the patient is put in the chair.

A hospital worker or the patient himself can then operate the portable sitz bath therapeutic chair by means of switches 82, 84 and 86 on control panel 28. Switch 82 would turn the system on, while switch 84 would start water 20 circulating through pump 44 to selectively controllable nozzles 46, 48 and 50 providing a stimulating massage to the desired areas in addition to treatment from the heat of the water. Nozzles 46, 48 and 50 are preferably the kind used in spas and therapeutic whirlpool baths that can be adjustably controlled to select the flow desired.

Switch 86 can be operated to heat the water should the water become too cool. This would continue for ten minutes or whatever time timer $T_1$ shown in the schematic of FIG. 6 is set for. Preferably timer $T_1$ would not be longer than ten minutes. The patient could then easily reset the timer by activating the pump again through pump switch 84. When treatment is finished the water can be drained through drain 94 and plug port 98 by gravity or as previously described or pumped out through a hose connected to outlet 55. The patient may then be removed from the chair, dried and returned to his bed.

Thus there has been disclosed a completely portable sitz bath therapeutic chair which will allow a patient to be treated at his bedside. It is particularly applicable to patients who are marginally ambulatory or are bedridden. It not only provides the usual treatment of a sitz bath to posterior portions of a patient but also will allow the patient to have the added benefit of the massaging effect of circulated and aerated water. The patient has complete control of circulation and treatment in the comfort of his own hospital room without having to be transported to another area of the hospital.

This invention is not to be limited by the embodiment shown in the drawings and described in the description which is given by way of example and not of limitation, but only in accordance with the scope of the appended claims.

What is claimed is:

1. A portable sitz bath chair comprising;

a frame forming a chair having a pair of arms, a back and a sloping front for supporting the legs of a patient;

a basin formed in said frame for holding a treating liquid, said basin being constructed for immersing only a posterior portion of a patient in said treating liquid;

said basin having a lower portion defining;

a perforated shelf to allow said treating fluid to flow around the posterior portion of a patient resting on said shelf;

circulating means for circulating said treating liquid to provide a massaging action to said posterior portion of said patient, said circulating means comprising a pump having an inlet and at least one outlet connected to said basin, said inlet being in communication with said perforated shelf, a plurality of nozzle jets means in said basin for circulating said treating liquid, and control means for turning said pump on and off;

said control means comprising a switch mounted in one of the arms of said chair for operation by the patient, timer means for controlling the length of time said pump operates, safety power supply means to prevent unsupervised operation of said sitz bath chair, and liquid level sensing means to prevent operation of the pump when the treating liquid is below a predetermined level;

drain means for draining said basin;

a plurality of wheels on said frame for transporting said portable sitz bath chair to a patient's location for treatment;

whereby said portable sitz bath chair may be transported to the location of a patient for treatment.

2. The portable sitz bath chair according to claim 1 including; heating means for heating the treating liquid while it is being circulated by said pump and heating control means for turning said heating means on and off while said pump is circulating said treating liquid.

3. The portable sitz bath chair according to claim 2 in which said heating control means includes a switch operable by said patient; and switch defeating means to prevent operation of said heating means when said pump is off.

4. The portable sitz bath chair according to claim 3 including temperature sensing means for sensing the temperature of said treating liquid in said basin, and circuit disabling means responsive to said temperature sensing means for disabling said pump when the temperature of said treating liquid exceeds a predetermined amount.

5. The chair according to claim 4 in which said temperature sensing means comprises a bi-metal temperature sensing element that prevents operation of said circulating means when said liquid equals or exceeds a predetermined temperature.

6. The chair according to claim 5 in which said temperature sensing means includes a fail safe thermal fuse in series with said bi-metal temperature sensing element.

7. The chair according to claim 4 in which said temperature sensing means comprises a thermal fuse, said thermal fuse stopping operation of said circulating means when said liquid exceeds a predetermined temperature.

8. The chair according to claim 1 in which said level sensing means comprises a float switch mounted in said basin at a predetermined minimum level for said liquid; whereby said circulating means will not operate until said liquid level rises to or above said float switch.

9. The chair according to claim 1 including air intake means connected to said plurality of nozzle jet means for aerating the liquid as it exits said nozzle means for enhancing the stimulation and treatment by said liquid.

10. The chair according to claim 9 in which said air intake means is adjustable for varying the aerating air added to said circulating liquid.

11. The chair according to claim 10 in which said adjustable air intake means comprises a plurality of air intake means positioned on the arms of said frame for adjustment by a patient during treatment.

12. The chair according to claim 11 in which said adjustable air intake means are adjustable from a predetermined maximum to a completely off position.

13. The chair according to claim 1 in which the slope of said sloping front of said frame is selected to provide optimum positioning and support of the legs of a patient during treatment of the posterior area.

14. The chair according to claim 1 including an adjustable foot support mounted at an upper edge of said sloping front of said frame for comfortably supporting a patient's feet and lower legs during treatment.

* * * * *